US005837167A

United States Patent [19]

Lederer

[11] Patent Number: 5,837,167

[45] **Date of Patent: *Nov. 17, 1998**

[54] COMPACT PORTABLE MISTING FAN

[76] Inventor: Jeffrey H. Lederer, 56 Husted La., Greenwich, Conn. 06830

[ * ] Notice: The term of this patent shall not extend beyond the expiration date of Pat. No. 5,667,732.

[21] Appl. No.: 851,601

[22] Filed: May 5, 1997

Related U.S. Application Data

[63] Continuation of Ser. No. 521,311, Aug. 30, 1995, Pat. No. 5,667,732.

[51] Int. Cl.[6] ..... B01F 3/04

[52] U.S. Cl. ..... 261/28; 261/30; 261/34.1; 261/72.1; 261/78.2; 261/89; 261/90; 239/289

[58] Field of Search ..... 261/30, 72.1, 78.1, 261/78.2, 28, 34.1, 84, 89, 90; 239/375, 340, 349, 338, 302, 289, 214.25, 222.11

[56] References Cited

U.S. PATENT DOCUMENTS 1,176,669 3/1916 Endres et al. ..... 239/338
3,522,806 8/1970 Szekely ..... 239/338
4,700,494 10/1987 Pridgen ..... 34/90
4,839,106 6/1989 Steiner ..... 261/28
5,338,495 8/1994 Steiner ..... 261/28

*Primary Examiner*—Khanh P. Nguyen
*Attorney, Agent, or Firm*—Galgano & Burke

[57] ABSTRACT

A compact portable misting fan includes a novel and attractive housing which makes extremely efficient use of space, encased fan blades which are mounted between front and rear baffles, a liquid reservoir with an atomizer, conveniently located mist and fan controls, and an easily accessible battery compartment. The housing has a substantially flat profile with a substantially cylindrical upper section in which the fan is mounted and a substantially rectilinear lower section in which the reservoir and batteries are contained. The fan on/off switch is located on a lower portion of the cylindrical upper section and the misting button is located on an upper portion of the rectilinear lower section and on a side opposite to the fan switch. It is easily held in the user's hand so that the fan and the mister can be operated separately by thumb or index finger. A small hole is provided in the housing for the outlet of the atomizer. The outlet is preferably angled upward so that mist is sprayed into the path of air from the fan.

23 Claims, 7 Drawing Sheets

COMPACT PORTABLE MISTING FAN

This is a continuation of application Ser. No. 08/521,311 filled on Aug. 30, 1995 and which issued as U.S. Pat. No. 5,667,732 on Sep. 16, 1997.

BACKGROUND OF THE INVENTION

1. Field of the Invention

The invention relates to a portable misting fan. More particularly, the invention relates to a compact hand-held portable misting fan which may be operated with one hand.

2. State of the Art

Portable misting fans are known in the art. They have a variety of uses, but are most commonly used as a personal relief from hot weather conditions. The known misting fans generally include a battery operated fan, a separate detachable water reservoir, and a fluid pump which dispenses a water spray which is dispersed by the fan. When the fan is directed at the face of a user and the water spray is dispensed, a cooling wet breeze is felt on the face of the user. Most people find this to be refreshing in hot weather conditions. While all of the known misting fans are substantially the same in principle, each has its own features and disadvantages.

U.S. Pat. No. 3,977,115 to Licudine discloses a portable atomizer for liquids which includes open propeller-like fan blades mounted on the end of an L-shaped housing. The housing contains batteries, a motor, a liquid reservoir, and a motor driven fluid pump. The motor is connected by a shaft and gears to both the fan blades and to the fluid pump and is activated by a switch on the side of the housing. The outlet of the fluid pump is located behind the fan blades. The portable atomizer has several disadvantages. First, the open fan blades can be dangerous and prone to failure. The blades can strike a person's face or fingers, catch on an article of clothing or jewelry, etc. Second, it is impossible to regulate the amount of mist dispensed. As soon as the fan is turned on, the mist is dispensed at a preset rate. When used as a personal relief from hot weather, it is desirable that the user have control over how much mist is dispensed.

U.S. Pat. No. 4,839,106 to Steiner discloses a portable misting fan which also has an L-shaped housing. Steiner encases the fan blades in the housing which overcomes one of the disadvantages mentioned above. In lieu of a motor driven fluid pump, Steiner provides a vacuum bulb which is coupled to the fluid reservoir by a flexible tube. This allows the user to regulate the amount of mist dispensed. Nevertheless, Steiner's fan has different disadvantages. First, it is not really designed for hand held operation. It has a relatively long flexible neck and a mounting clip on its base. It is designed to be mounted on a support structure such as a lawn chair or the like. Moreover, if the fan were held in the user's hand, it could not be operated with one hand. The dangling tube with the vacuum bulb must be held by the user in the other hand. Regulation of the fan and the mist is a two-handed operation. In addition, Steiner's fan has a serious design flaw which may prevent it from operating at all. The fan blades are mounted inside the housing and a baffle vent is mounted in front of the blades, but there is no vent in back of the blades. Therefore, there is no way air can get in back of the blades to be driven forward by the rotating blades.

U.S. Pat. No. 5,338,495 to Steiner et al. discloses a hand held portable misting fan which is designed like the trigger sprayer of a household cleanser. The relatively large bottle-like water reservoir is detachable from the apparatus in the same manner as a bottle of cleanser is detached from a trigger sprayer. Water spray is dispensed by squeezing a trigger which squirts water at the back of open rotating fan blades. While this misting fan has the advantages of being hand held and operable with one hand, it has several disadvantages. As discussed above, the open fan blades are hazardous and prone to failure. To overcome the substantial hazard of the open blades, Steiner et al. propose the use of flexible foam blades. These light weight flexible blades tend to be ineffective, however, and little breeze is generated by a fan with these types of blades. The location of the water outlet behind the fan blades requires that the fan be turned on in order to dispense mist. Moreover, the trigger-style sprayer tends to dispense an inappropriately large amount of water. This, combined with the inefficiency of the fan blades, results in the production of a wet stream of water and little or no breeze. In addition, the overall shape of the apparatus is inconvenient for travel. It will not fit easily in a pocket, purse, or bag, for example.

SUMMARY OF THE INVENTION

It is therefore an object of the invention to provide a compact portable misting fan which has hand held operation.

It is also an object of the invention to provide a compact portable misting fan which can be easily operated with one hand.

It is another object of the invention to provide a compact portable misting fan which has encased fan blades.

It is still another object of the invention to provide a compact portable misting fan which has separate fan and mist controls which can be operated independently of each other.

It is another object of the invention to provide a compact portable misting fan which allows misting with the fan turned off.

It is still another object of the invention to provide a compact portable misting fan which emits a fine spray.

It is also an object of the invention to provide a compact portable misting fan which makes efficient use of space and can fit in the user's pocket, purse or bag.

It is another object of the invention to provide a compact portable misting fan which utilizes an efficient powerful fan.

It is another object of the invention to provide a compact portable misting fan which can hang from a lanyard around a user's neck.

It is also an object of the invention to provide a compact portable misting fan which is contained in a substantially flat housing.

It is still another object of the invention to provide a compact portable misting fan which has an easily accessible water reservoir.

It is yet another object of the invention to provide a compact portable misting fan which has an non-removable self-contained water reservoir.

It is still another object of the invention to provide a compact portable misting fan which can be easily operated by children and adults.

In accord with these objects which will be discussed in detail below, the compact portable misting fan of the present invention includes a novel and attractive housing which makes extremely efficient use of space, encased fan blades which are mounted between a front and a rear baffle, a liquid reservoir with a self-contained atomizer, conveniently located mist and fan controls, and an easily accessible battery compartment. The housing has a substantially flat profile with a substantially cylindrical upper section in which the fan is mounted and a substantially rectilinear lower section in which the reservoir and batteries are contained. The fan on/off switch is located on a lower portion of the cylindrical upper section of the housing and the misting button is located on an upper portion of the rectilinear lower section of the housing. The invention is therefore easily held in the user's hand so that the fan and the mister can be operated by thumb or index finger. The liquid reservoir is preferably located immediately below the fan and a small hole is provided in the housing for the outlet of the atomizer. The self-contained atomizer outlet is preferably angled slightly upward so that mist is sprayed into the path of air from the fan. A removable panel is provided in the back of the housing for removal and replacement of batteries. The housing is optionally provided with an eyelet for receiving a lanyard.

According to one embodiment of the invention, the liquid reservoir is removable and a removable panel is provided for access to the reservoir. In this embodiment, the misting button and the fan on/off switch are preferably located on opposite sides of the housing. In another embodiment, the liquid reservoir is self-contained and non-removable from the housing. In this embodiment, the misting button and the reservoir filler cap are located on the opposite sides of the housing.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 2:
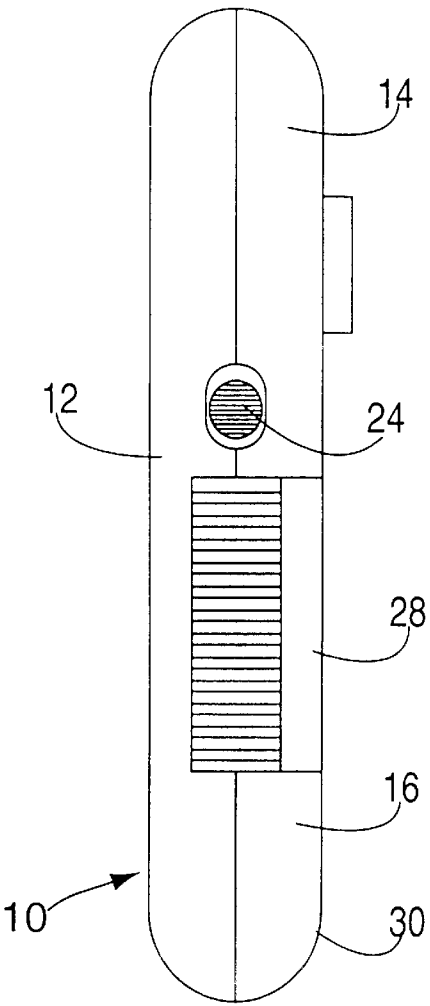
FIG. 2 is a right side elevation view of a first embodiment of the compact portable misting fan of FIG. 1.
Figure 1:
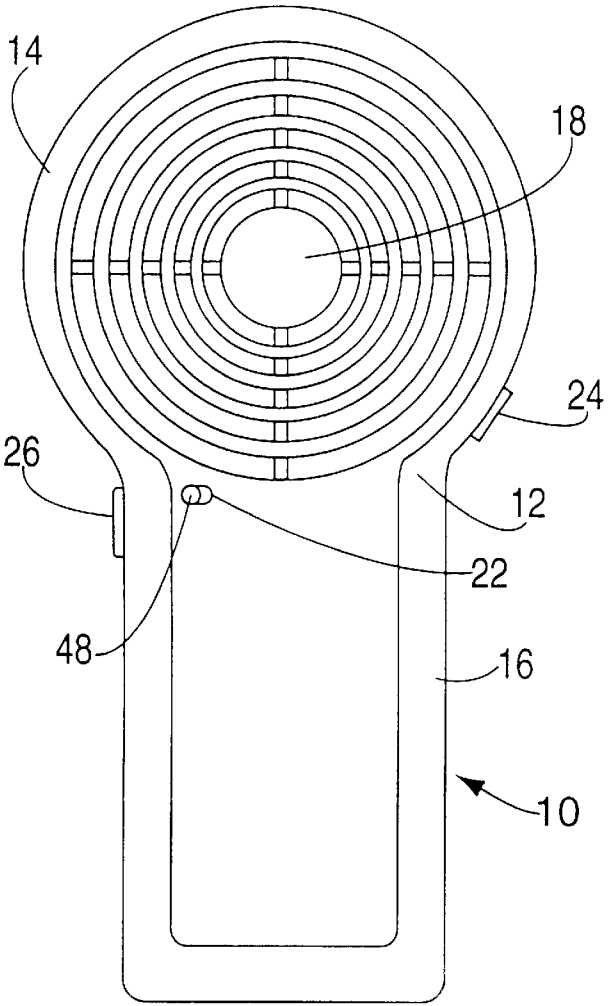
FIG. 1 is a front elevation view of a compact portable misting fan according to the invention.
Figure 3:
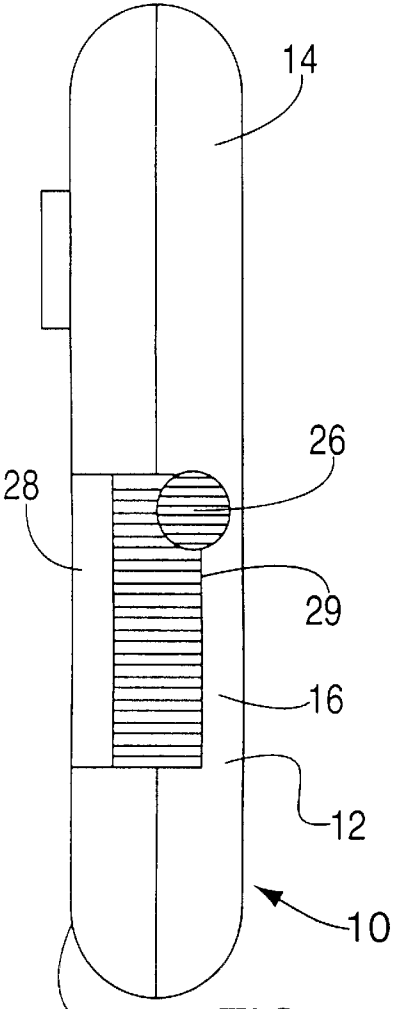
FIG. 3 is a left side elevation view of a first embodiment of the compact portable misting fan of FIG. 1.

Referring now to FIGS. 1 through 4, the compact portable misting fan 10 of the present invention includes a novel and attractive housing 12 which makes extremely efficient use of space. The housing 12 has a substantially flat profile with a substantially cylindrical upper section 14 and a substantially rectilinear lower section 16. The upper section 14 has a front air baffle 18 and a rear air baffle 20. A small opening 22 is provided in the front of the lower section 16 immediately below the front air baffle 18 for receiving the outlet of an atomizer as described below. An on/off switch 24 is located on a lower portion of the right hand side of the cylindrical upper section 14 of the housing and an atomizer push button 26 is located on an upper portion of the left hand side of the rectilinear lower section 16. The housing is dimensioned to fit easily in a user's right hand so that the on/off switch 24 can be operated by the user's thumb and the push button 26 can be operated by the user's index finger.

Figure 6:
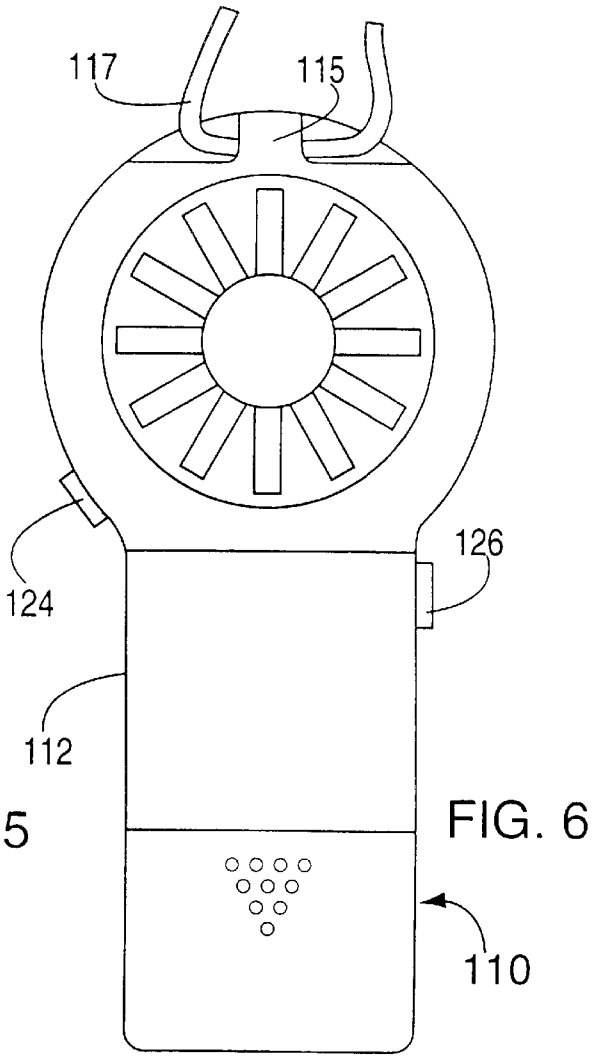
FIG. 6 is a view similar to FIG. 4 of the second embodiment of a compact portable misting fan according to the invention.
Figure 5:
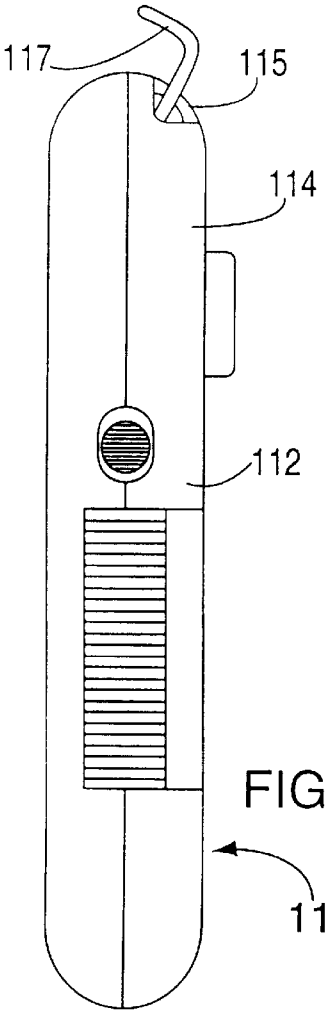
FIG. 5 is a view similar to FIG. 2 of a second embodiment of a compact portable misting fan according to the invention.

The lower section 16 of the housing 12 also includes a pair of removable panels 28, 30 for accessing the interior of the housing as described below. As shown in FIGS. 5 and 6, in a second embodiment of the invention, the housing 112 is provided with an eyelet 115 for receiving a lanyard 117. The eyelet 115 is preferably located on the rear of the housing 112 at the upper most portion of the cylindrical upper section 114.

Figure 4:
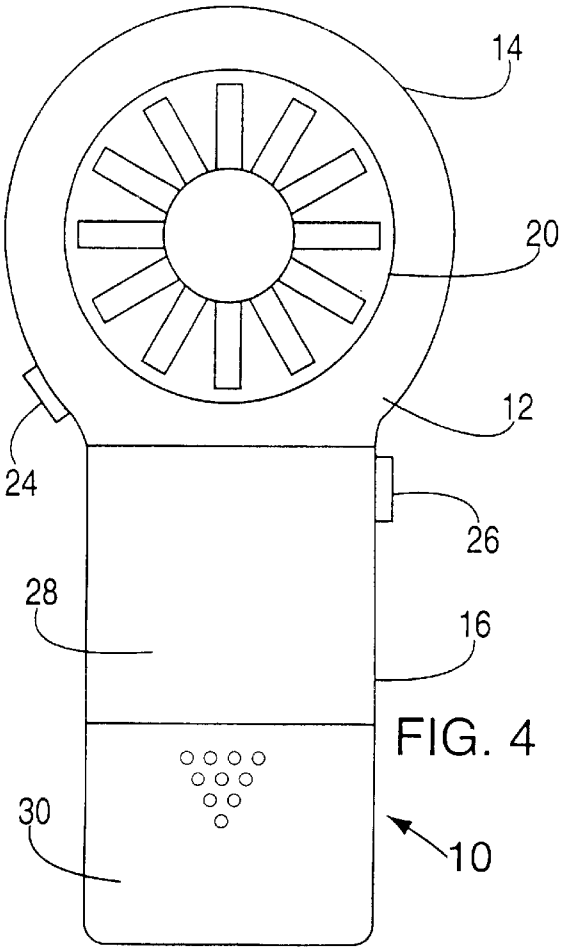
FIG. 4 is a rear side elevation view of a first embodiment of the compact portable misting fan of FIG. 1.
Figure 7:
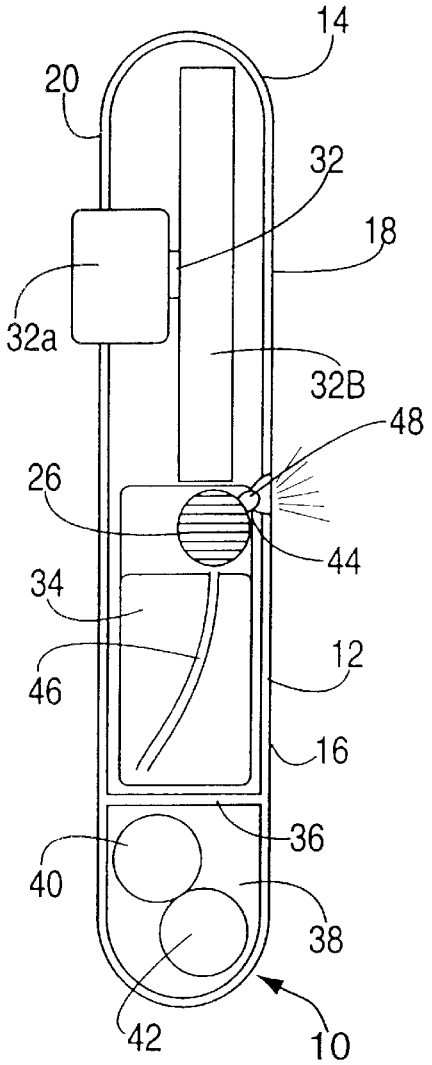
FIG. 7 is a partially transparent left side elevation view a compact portable misting fan according to the invention.
Figure 8:
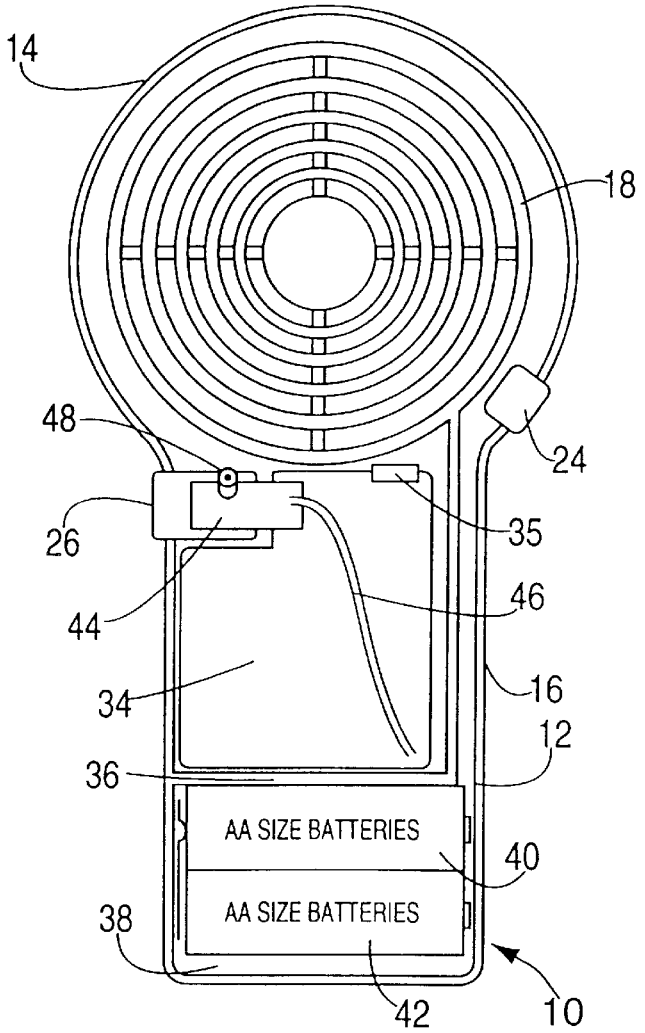
FIG. 8 is a partially transparent front elevation view a compact portable misting fan according to the invention.

Turning now to FIGS. 7 and 8, a fan assembly 32 is mounted in the upper cylindrical section 14 of the housing 12 in between the front baffle 18 and the rear baffle 20. The fan assembly 32 includes a motor 32*a* and fan blades 32*b*. The fan assembly 32 is arranged so that when it is activated, air is drawn into the housing from the rear baffle 20 and blown out of the housing through the front baffle 18. A removable water reservoir 34 is located immediately below the fan assembly 32 in the lower rectilinear section 16 of the housing 12. A cross member 36 is provided to support the reservoir 34. A battery compartment 38 is located below the cross member 36 and contains two size AA batteries 40, 42. The batteries 40, 42 are electrically coupled to the fan motor 32*a* via the switch 24 and they are held in the housing by the removable panel 30 (FIG. 4).

The reservoir 34 is substantially rectilinear and is provided with a self-contained atomizer 44 which extends horizontally left from a top portion of the reservoir. The atomizer 44 has a supply tube 46 which extends down into the reservoir, a spray outlet 48 which extends forward and upward at an angle from the horizontal, and a push button 26 which extends horizontally left. A filling cap or plug 35 is located on a top portion of the reservoir 34. From the foregoing, it will be appreciated that when the removable reservoir 34 is placed in the housing 12, the spray outlet 48 aligns with the opening 22 (FIG. 1) in the front of the housing and the push button 26 extends out of the left side of the housing. It will also be appreciated that the reservoir 34 is held inside the housing by the removable panel 28 (FIG. 3) which is provided with a side opening 29 through which the push button 26 extends. It will further be understood that the reservoir 34 may be removed from the housing 12 by removing the panel 28 and may be refilled with water by removing the filler cap 35.

When the misting fan 10 is held in the user's right hand, the fan is turned on my moving the switch 24 with the user's right thumb. Water mist is sprayed by pressing the push button 26 with the user's right index or middle finger. The design of the housing and the location of the controls are ergonomic and make the fan extremely easy to use. The mist sprayer and the fan operate independently of each other. The fan blades are safely encased within the housing yet move air freely due to the location of the baffles. The compact and substantially flat housing makes efficient use of space and the fan 10 can be fit in a user's pocket.

Turning now to FIGS. 9–14, a third, and presently preferred, embodiment of a portable misting fan 200 is shown. The portable misting fan 200 is similar to the misting fans 10 and 100 described above with similar reference numerals referring to similar features and components. The major differences between the misting fan 200 and the misting fans 10 and 100 concern the reservoir 234, the atomizer 244, the battery compartment 238, and the assembly of the housing 212. In particular, the reservoir 234 is not removable and extends substantially the entire length of the rectilinear portion 216 of the housing 212. As seen best in FIGS. 12 and 14, the reservoir 234 has an L-shaped profile from both the front and the side. Specifically, the reservoir 234 has a middle portion 234*a* which extends across substantially the entire width and depth of the housing, an upper portion 234*a* which extends across substantially the entire depth of the housing but less than half the width of the housing, and a lower portion 234*c* which extends across substantially the entire width, but less than half the depth of the housing. The upper portion 234*b* has an outer threaded coupling 250 and an inner threaded coupling 252. As seen best in FIGS. 9 and 10, the outer coupling 250 is fitted with a removable filler cap 235 and the inner coupling 252 is fitted with a removable atomizer 244, described in more detail below. As seen best in FIG. 14, the lower portion 234*c* of the reservoir 234 extends alongside the battery compartment 238 which is separated from the reservoir by a shell 236. Both the shell 236 and the lower portion 234*c* of the reservoir 234 are provided with respective through passages 254, 256 (see FIGS. 12 and 13) to accommodate a screw 258 as described in more detail below.

Figure 9A:
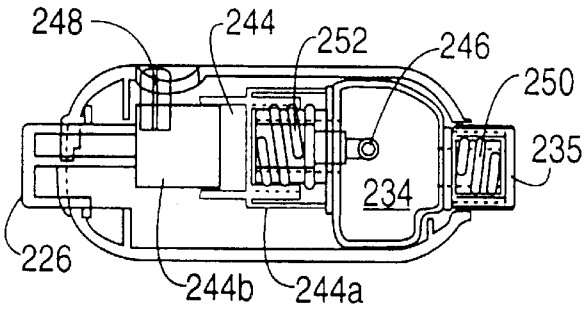
FIG. 9*a* is a cross sectional view taken along line 9A—9A in FIG. 9.
Figure 9B:
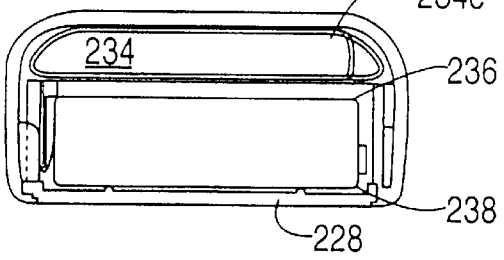
FIG. 9*b* is a cross sectional view taken along line 9B—9B in FIG. 9.
Figure 9:
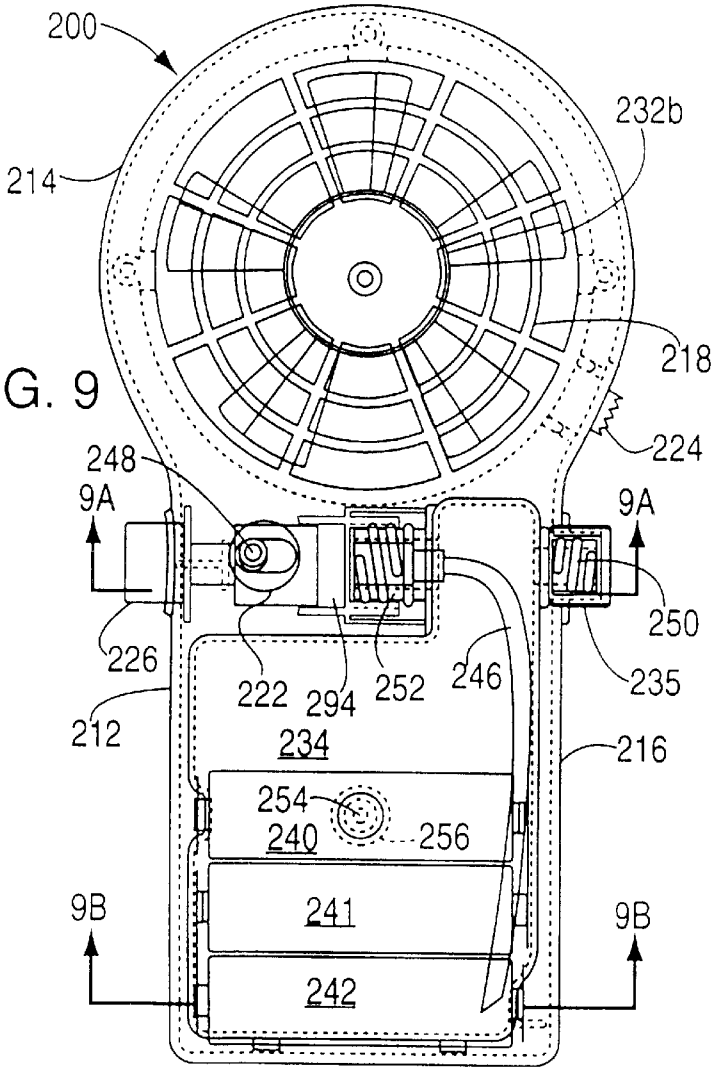
FIG. 9 is a transparent front elevation view of a third embodiment of a compact portable misting fan according to the invention.
Figure 10:
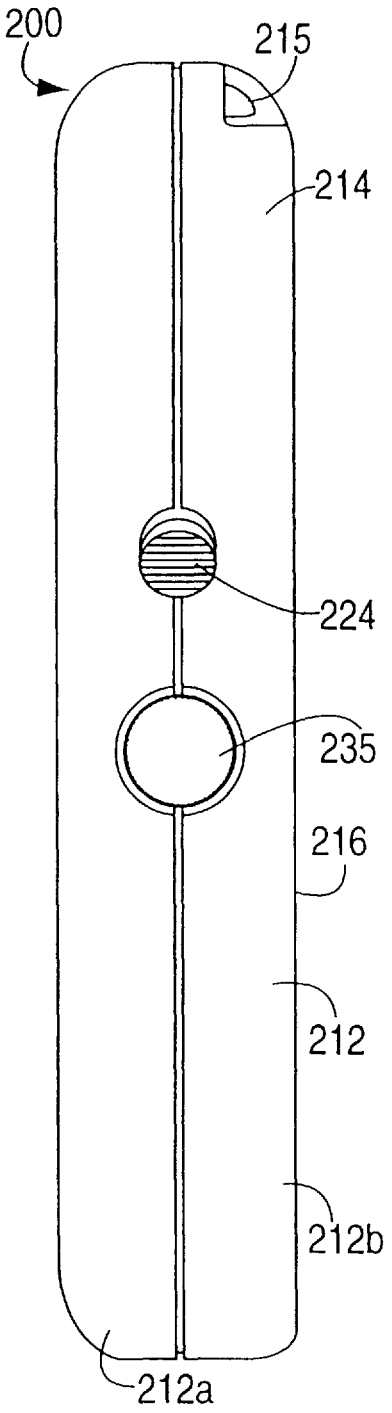
FIG. 10 is a right side elevation view of the compact portable misting fan of FIG. 9.

As seen best in FIGS. 9 and 9*a*, the atomizer 244 has a screw cap 244*a* which allows it to be removably coupled to the inner coupling 252 of the reservoir 234, and a head 244*b* with an integral spray outlet 248. The atomizer 244 may be an "off the shelf" perfume atomizer, and the push button 226 may be a flanged extension plunger which contacts the head 244*b*.

Figure 11:
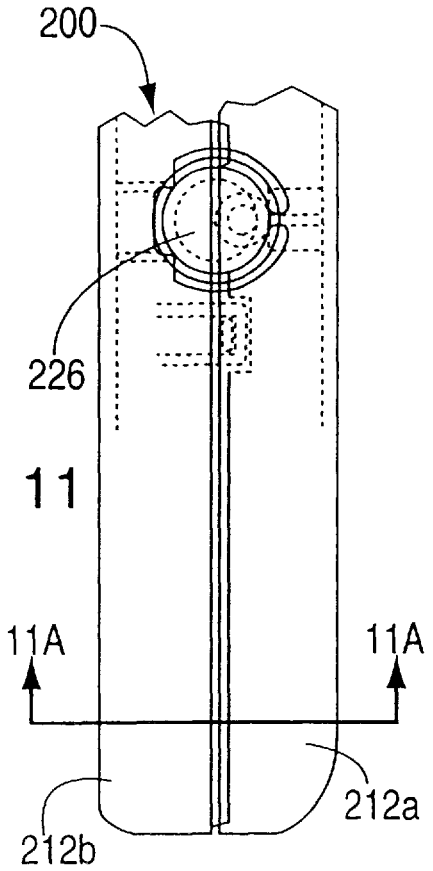
FIG. 11 is a broken left side elevation view of the compact portable misting fan of FIG. 9.
Figure 11A:
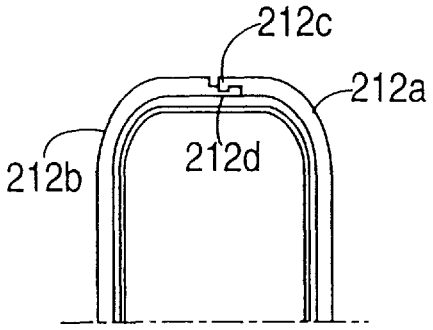
FIG. 11*a* is a broken cross sectional view taken along line 11A—11A in FIG. 11.
Figure 12A:
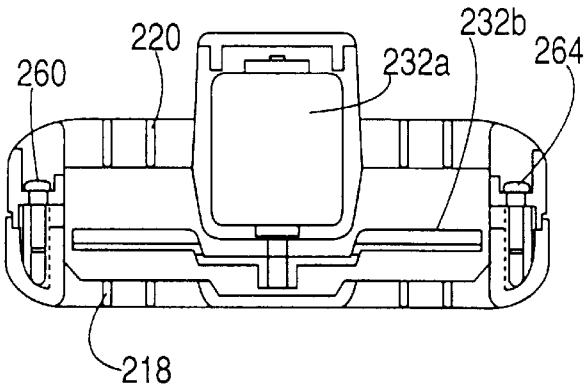
FIG. 12*a* is a cross sectional view taken along line 12A—12A in FIG. 12.
Figure 12B:
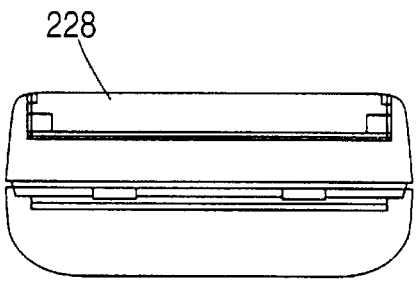
FIG. 12*b* is a cross sectional view taken along line 12B—12B in Figure 12.
Figure 12:
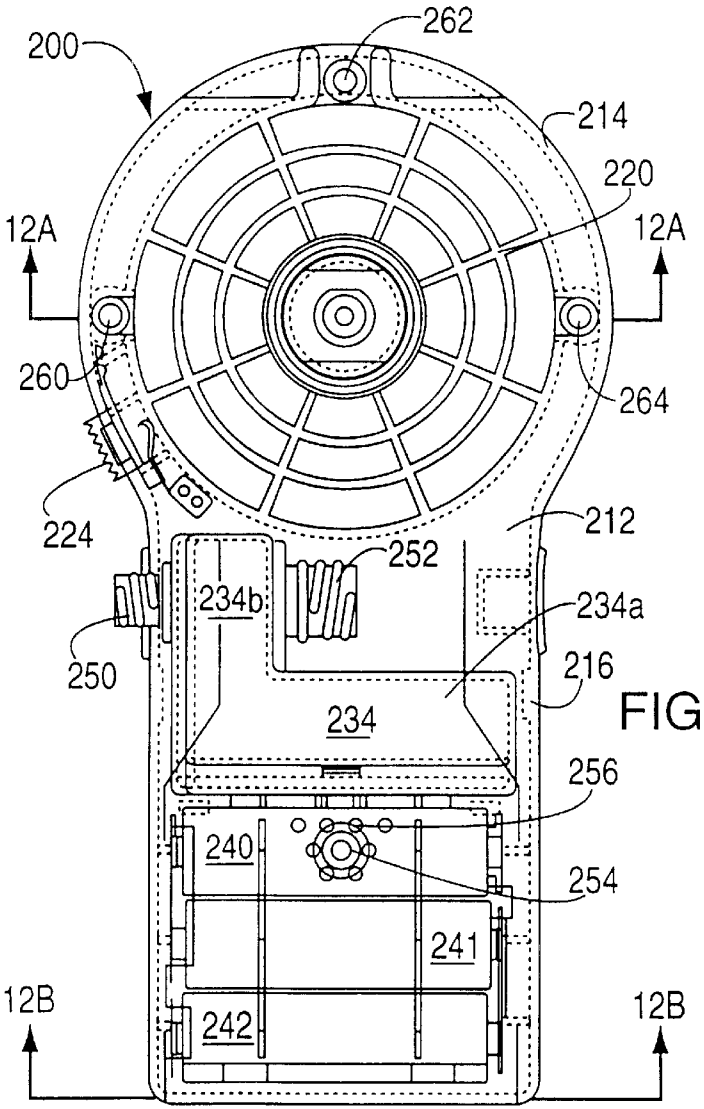
FIG. 12 is a transparent rear elevation view of the compact portable misting fan of FIG. 9 with the atomizer and filler cap removed from the reservoir.
Figure 13:
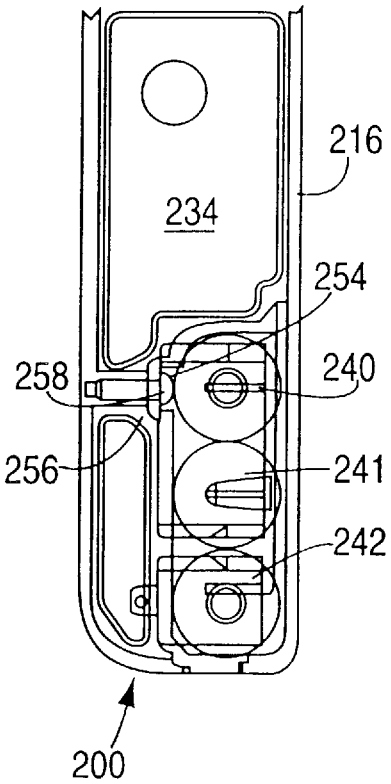
FIG. 13 is a broken transparent right side elevation view of the compact portable misting fan of FIG. 9.
Figure 14:
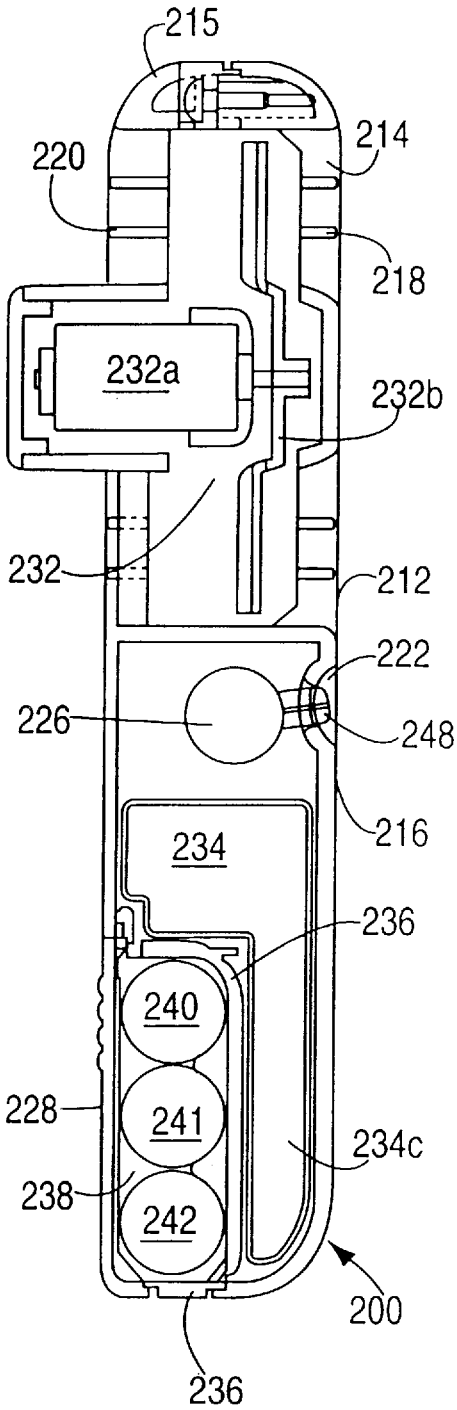
FIG. 14 is a transparent left side elevation view of the compact portable misting fan of FIG. 9.

As seen best in FIGS. 11 and 11*a*, the housing 212 is preferably composed of a front piece 212*a* and a rear piece 212*b*. The front piece 212*a* is preferably provided with a peripheral lip 212*c* and the rear piece 212*b* is preferably provided with a mating peripheral groove 212*d*. The housing pieces 212*a* and 212*b* are preferably held together with four screws 258, 260, 262, and 264. As mentioned above, the screw 258 secures the battery compartment portion of the housing. The screws 260–264 secure the upper cylindrical portion 214 of the housing as seen best in FIGS. 12, 12*a*, and 14.

There have been described and illustrated herein several embodiments of a compact portable misting fan. While particular embodiments of the invention have been described, it is not intended that the invention be limited thereto, as it is intended that the invention be as broad in scope as the art will allow and that the specification be read likewise. Thus, while particular right and left locations have been disclosed, it will be appreciated that these locations could be reversed for a left handed user. Alternatively, operations described as performed by the user's thumb and finger would be reversed.

Also, while size AA batteries have been shown, it will be recognized that other types of batteries could be used with similar results obtained. It will also be appreciated that a solar cell and rechargeable batteries could be used in a known manner without departing from the spirit of the invention. Moreover, while particular configurations have been disclosed in reference to an eyelet for a lanyard, it will be appreciated that other configurations could be used as well. For example, the eyelet could be located at the bottom or on a middle portion of the housing. A belt clip could also be provided on the housing.

Furthermore, while the reservoir has been disclosed as being located above and alongside the batteries, it will be understood that slightly different locations of the reservoir and batteries can achieve the same or similar function as disclosed herein. In addition, while the housing of the first and second embodiments has been shown with two removable panels, one panel could be used to provide simultaneous access to both the reservoir and the batteries.

It will therefore be appreciated by those skilled in the art that yet other modifications could be made to the provided invention without deviating from its spirit and scope as so claimed.

I claim:

1. A compact hand held portable misting fan operable by one hand of a user, said fan comprising:

a) a housing dimensioned to be easily held in the user's hand, said housing having a front air baffle and a rear air baffle;

b) an electric fan mounted in said housing;

c) a fluid container mounted in said housing;

d) an electrical switch for supplying power to said electric fan, said electrical switch being mounted on said housing; and e) an atomizer coupled to said fluid container for pumping fluid from said fluid container and atomizing said fluid, said atomizer having a spray outlet and a push button mounted on said housing wherein when said fan is held in the user's hand, said switch can be activated by a thumb or finger and said push button can be pushed by a finger or thumb, respectively, of the same hand.

2. A compact portable misting fan according to claim 1, wherein:

said electrical switch is mounted on a first side of said housing, and said push button extends out of a second side of said housing, said second side being opposite said first side.

3. A compact portable misting fan according to claim 1, wherein:

said housing has a removable panel and said liquid container is removable from said housing via said removable panel.

4. A compact portable misting fan according to claim 1, wherein:

said liquid container has a filling cap which is located outside of said housing.

5. A compact portable misting fan according to claim 1, wherein:

said electric fan is mounted in an upper portion of said housing, said upper portion of said housing being substantially cylindrical in shape, and said liquid container is mounted in a lower portion of said housing, said lower portion of said housing being substantially rectilinear in shape.

6. A compact portable misting fan according to claim 1, wherein:

said spray outlet extends out of said housing at an angle toward said front air baffle.

7. A compact portable misting fan according to claim 1, wherein:

said housing is provided with an eyelet for receiving a lanyard.

8. A compact portable misting fan according to claim 1, wherein:

said housing is substantially flat.

9. A compact portable misting fan according to claim 5, wherein:

said electrical switch is mounted on said upper portion of said housing, and said push button extends out of said lower portion of said housing.

10. A compact portable misting fan according to claim 5, wherein:

said spray outlet extends out of said lower portion of said housing at an angle toward said front air baffle.

11. A compact hand held portable misting fan operable by one hand of a user, said fan comprising:

a) a substantially flat housing dimensioned to be held in a child or adult human hand, said housing having an upper substantially cylindrical part and a lower substantially rectilinear part;

b) an electric fan mounted in said housing;

c) a fluid container mounted in said housing;

d) an electrical switch for supplying power to said electric fan, said electrical switch being mounted on said housing; and e) an atomizer coupled to said fluid container for pumping fluid from said fluid container and atomizing said fluid, said atomizer having a spray outlet and a push button mounted on said housing, wherein when said fan is held in the user's hand, said switch can be activated by a thumb or finger and said push button can be pushed by a finger or thumb, respectively, of the same hand.

12. A compact portable misting fan according to claim 11, wherein:

said electrical switch is mounted on a first side of said housing, and said push button extends out of a second side of said housing, said second side being opposite said first side.

13. A compact portable misting fan according to claim 11, wherein:

said housing has a removable panel and said liquid container is removable from said housing via said removable panel.

14. A compact portable misting fan according to claim 11, wherein:

said liquid container has a removable filler cap which is accessible from the outside of said housing.

15. A compact portable misting fan according to claim 11, wherein:

said spray outlet extends out of said housing at an angle toward said upper substantially cylindrical part.

16. A compact portable misting fan according to claim 11, wherein:

said housing is provided with an eyelet for receiving a lanyard.

17. A compact hand held portable misting fan operable by one hand of a user, said fan comprising:

a) a substantially flat housing dimensioned to be held in the user's hand;

b) an electric fan mounted in said housing;

c) a fluid container mounted in said housing;

d) an electrical switch for supplying power to said electric fan, said electrical switch being mounted on said housing; and e) an atomizer coupled to said fluid container for pumping fluid from said fluid container and atomizing said fluid, said atomizer having a spray outlet and a push button mounted on said housing, wherein when said fan is held in the user's hand said switch can be activated by a thumb or finger and said push button can be pushed by a finger or thumb, respectively, of the same hand.

18. A compact portable misting fan according to claim 17, wherein:

said electrical switch is mounted on said first side of said housing, and said push button extends out of said second side of said housing, said second side being opposite said first side.

19. A compact portable misting fan according to claim 17, wherein:

said housing has a removable panel and said liquid container is removable from said housing via said removable panel.

20. A compact portable misting fan according to claim 17, wherein:

said liquid container has a filling cap which extends out of a side of said housing.

21. A compact portable misting fan according to claim 17, wherein:

said spray outlet extends out of said lower part at an angle toward said upper part.

22. A compact portable misting fan according to claim 17, wherein:

said housing is provided with an eyelet for receiving a lanyard.

23. A compact portable misting fan according to claim 17, wherein:

said electrical switch is mounted on said upper part, and said push button extends out of said lower part.

* * * * *